United States Patent [19]

Cohen

[11] 3,950,829

[45] Apr. 20, 1976

[54] HANGER CLIP

[76] Inventor: Maurice Cohen, 3580 NW. 52nd St., Miami, Fla. 33142

[22] Filed: June 3, 1974

[21] Appl. No.: 476,096

[52] U.S. Cl. ..... 211/124; 223/91; 223/96; 24/251; 24/137 A

[51] Int. Cl.[2] ..... A47H 13/00; A41D 27/22

[58] Field of Search ..... 24/251, 252 CP, 252 GC, 24/252 B, 252 R, 137 A, DIG. 22; 211/124; 223/96, 91

[56] References Cited

UNITED STATES PATENTS

| | | | |
|---|---|---|---|
| 475,257 | 5/1892 | Thuge | 24/251 |
| 969,695 | 9/1910 | Holsey | 24/DIG. 22 |
| 1,030,386 | 6/1912 | Comeau | 24/251 |
| 1,795,622 | 3/1931 | Taylor | 223/96 |
| 1,893,508 | 1/1933 | Rosenberg | 24/252 CP |
| 2,261,005 | 10/1941 | Thompson | 24/137 A |
| 2,527,484 | 10/1950 | Lester | 24/251 |
| 2,666,240 | 1/1954 | Maccaferri | 24/137 A |
| 2,990,961 | 7/1961 | Schneider | 24/251 |
| 3,103,727 | 9/1963 | Carr | 24/137 A |
| 3,235,928 | 2/1966 | Clark | 24/137 |
| 3,471,069 | 10/1969 | Simon | 223/91 |
| 3,767,092 | 10/1973 | Batts | 24/251 |

FOREIGN PATENTS OR APPLICATIONS

| | | | |
|---|---|---|---|
| 907,450 | 5/1950 | France | 24/251 |
| 627,805 | 8/1949 | United Kingdom | 24/137 A |
| 127,768 | 5/1948 | Australia | 24/137 A |
| 143,506 | 9/1951 | Australia | 24/137 A |
| 596,141 | 12/1947 | United Kingdom | 24/137 A |

*Primary Examiner*—Bernard A. Gelak
*Attorney, Agent, or Firm*—Salter & Michaelson

[57] ABSTRACT

A clip for retaining an article in suspended position including a pair of jaw members that are hingedly interconnected and that are pivotally movable to a closed position for clamping the article therebetween, a spring member being mounted on the jaw members for relative movement with respect thereto and including leg elements that overlie the jaw members in the closed position for urging the jaw members into clamping engagement with the article, means being formed on said leg elements that cooperate with means formed on said jaw members for moving said jaw members to the fully open position upon outward movement of said spring member relative to said jaw members.

16 Claims, 12 Drawing Figures

HANGER CLIP

BACKGROUND OF THE INVENTION

The present invention relates to a clip for use in retaining an article in suspended position therefrom.

Garment retaining clips for use on hangers are well known in the art, and traditionally have included pivotally mounted jaw members having a spring element located therebetween, the jaw members being moved to an open position by depression thereof against the action of the spring. Such clips were objectionable for several reasons, one of which was that the manipulation of both hands to locate a garment between the jaws of the clip was required, and this was difficult to achieve since it was necessary to use one hand to hold the jaws of the clips in an open position.

Prior to the instant invention some efforts have been made to incorporate a hanger clip that included a movable spring that was designed to force jaw members of the clip into engaging relation with the garment. Although at least one of such hanger clips has found some favor in the trade, it was not usable in all instances since it was formed as an integral part of a hanger construction and was not mounted on a separable hanger formed as part of a display rack. Other efforts have also been made to utilize spring elements in connection with jaw members of a clip, but these prior known devices were somewhat awkward, bulky and complicated in structure and were found to be prohibitive in cost in the manufacture thereof.

SUMMARY OF THE INVENTION

The present invention includes a clip for use separately or with an article retaining hanger which is relatively simple and inexpensive to manufacture. The clip as embodied in the present invention includes integrally cast hinge pivot pins or a horizontal hang rod, on which jaw members are hingedly mounted and that are pivotably movable to a closed position for clamping an article therebetween. Formed independently of the jaw members is a spring member that is mounted externally of the jaw members for relative movement with respect thereto and having leg elements that are urged inwardly toward each other and that overlie the jaw members in the closed position for urging the jaw members into clamping engagement with said article. The spring member cooperates with the jaw members for positively moving the jaw members in a pivotal movement to a fully open position when the spring member is pulled outwardly relative to the jaw members, the spring member also being movable inwardly relative to the jaw members to force the jaw members together for clamping the article therebetween. Means are formed on the jaw members that cooperate with means formed on the spring member for urging the jaw members to the fully open, outer pivotal position when the spring member is pulled outwardly relative to said jaw members.

Accordingly, it is an object of the present invention to provide a clip for retaining articles therebetween or for use on an article retaining hanger that includes a pair of jaw members on which a spring member is mounted, the spring member being movable for either closing the jaw members or moving them to the fully open position thereof.

Another object of the invention is to provide a hanger clip having jaw members and a spring, each being molded independently of a plastic material in a one-piece construction, the jaw members being pivotally mounted relative to each other, and the clip member being received on the jaw members for movement relative thereto for either opening or closing the jaw members.

Still another object is to provide a hanger clip having a spring member formed with spaced leg elements in a unitary construction that are mounted on a pair of jaw members and that are pivotally interconnected, a longitudinally extending ledge being formed on each jaw member adjacent and parallel to the hinge axis thereof and cooperating with an inwardly directed, parallel, longitudinally extending finger formed on each leg element of the spring member adjacent to the outermost end thereof for pivotally moving the jaw members to the fully open position thereof and for preventing disengagement of the jaw members and spring when said spring member is pulled outwardly relative to said jaw members.

Still another object is to provide a hanger clip having jaw members formed with slots therein, a spring member being mounted on said jaw members for relative movement with respect thereto for locating said jaw members in a clamping position and having "T" pins joined thereto that are receivable in the slots of said jaw members, wherein disengagement of said spring member from said jaw members is prevented when said spring member is moved to the open position thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
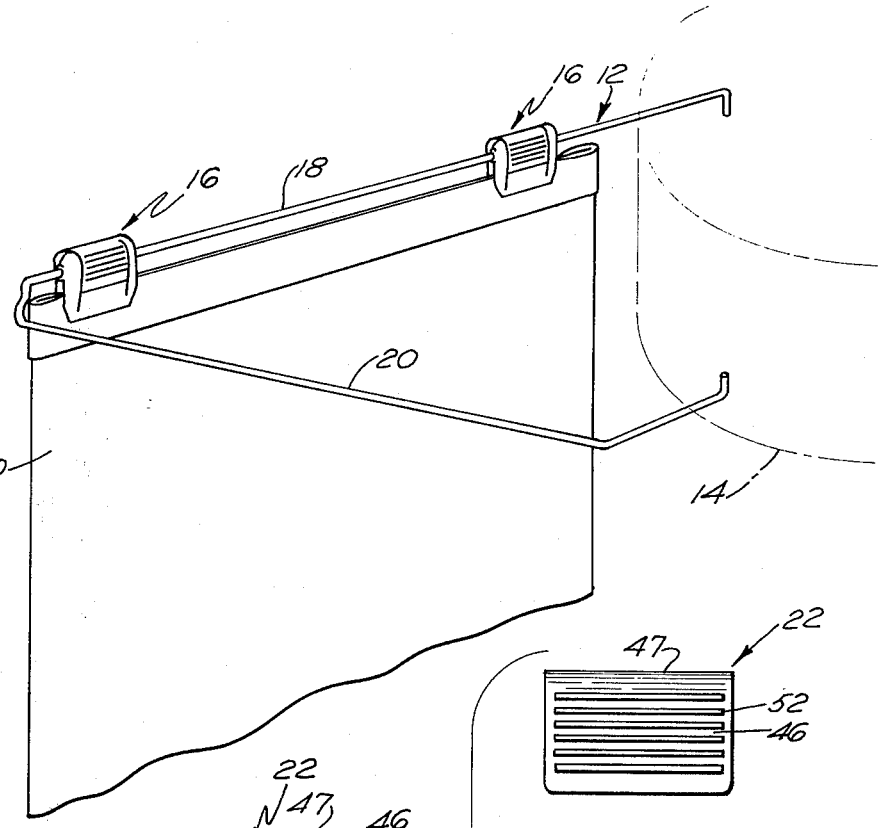
FIG. 1 is a perspective view showing a pair of clips as embodied in the present invention mounted on a horizontal hang rod of a garment display rack and further showing a garment suspended from the clips.
Figure 2:
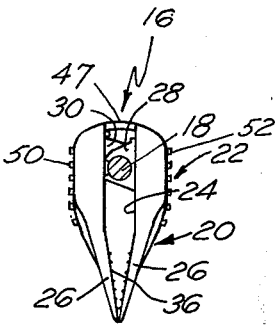
FIG. 2 is an end elevational view of a clip as mounted on a hang rod in the closed position, the hang rod being shown in section.

Referring to FIG. 1, a pair of clips as embodied in the present invention are illustrated suspending a garment 10 from a hanger generally indicated at 12, the hanger 12 being pivotally mounted on a support 14 of a display rack of any conventional construction. Each of the clips as embodied in the present invention is generally indicated at 16 and is mounted on a horizontal hang rod 18 of the hanger 12. The hanger 12 also includes an inclined support rod 20, the horizontal hang rod 18 and support rod 20 defining a two-point suspension hanger for the garment 10. As will be understood, each of the clips 16 may be mounted on any suitable hang rod that is generally located in a horizontal position, the hanger 12 constituting only one form of a hanger on which the clips 16 may be mounted.

Figure 5:
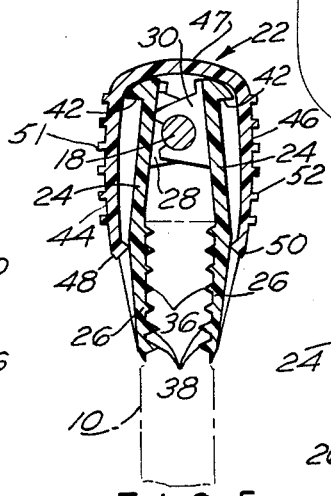
FIG. 5 is a view similar to FIG. 4, showing the clip located in the closed position.

Each clip 16 comprises three basic components, two of which define jaw members generally indicated at 20 that are identical in construction, the third being a spring member generally indicated at 22 that cooperates with the jaw members 20 for moving the jaw members to a fully open or closed position, as required. Each jaw member 20 includes an upper portion 24 to which a lower portion 26 is integrally joined, the lower portion 26 being somewhat inclined with respect to the upper portion 24, wherein the lower portion 26 of each clip defines a narrow restricted gap with the other lower portion when the clip is closed for locking an article therebetween as illustrated in FIG. 5. All of the component parts of the clips, that is, the jaw members 20 and the spring member 22, are molded of a suitable plastic material; and examples of such plastic materials that can be utilized in the molding of these parts are polyvinyl chloride, polypropylene and ABS.

Molded as an integral part of each of the jaw members 20 and on the rear surface of the upper portion 24 thereof are spaced hinge clamps 28 and 30, the hinge clamps 28 and 30 being formed with arcuate shaped grooves 32 and 34, respectively, therein. The grooves 32 and 34 conform generally to the curvature of the rod 18 of the hanger 12, and the edges of each of the grooves as defined by the edges of the clamps 28 and 30 are spaced apart sufficiently to enable the clamps 28 and 30 to be forced onto the rod 18 in friction fitting relation thereon. Since the hinge clamps 28 and 30 are molded of a plastic material, there is some resiliency that is inherent therein and that provides for forcing of the rod 18 between the edges of the grooves 32 and 34, so that the clamps 28 and 30 are snapped into friction fitting relation onto the rod 18 when the clip 16 is mounted in place thereon.

Formed on the lower portion 26 of each jaw member 20 and on the inside surface thereof below the hinge clamps 28 and 30 are two sets of projections indicated at 36 and 38. The projections 38 which are the last two rows of projections located adjacent to the lowermost end of the bottom portion 26, extend outwardly somewhat more than that of the projections 36 as more clearly illustrated in FIGS. 4 and 5. Thus, the projections 38 deeply penetrate into an article that is to be clamped between the jaw members 20 and act to positively retain the article therebetween in the clamped position as more clearly illustrated in FIG. 5.

It is seen that when the jaw members 20 are mounted in position on the hang rod 18, the spacing of the hinge clamps 28 and 30 on each of the jaw members 20 is such as to allow the opposed hinge clamps to be received on the hang rod in alternate relation, each hinge clamp of one jaw member being located adjacent to a hinge clamp of the other jaw member. It is also seen that the grooves 32 and 34 as formed in the hinge clamps 28 and 30 of each jaw member are coincident and in axial alignment so that when the hinge clamps are snapped in place on the hang rod 18 a continuous hinge axis is defined, the longitudinal axis of the hang rod 18 defining the hinge axis of the jaw members 16.

Figure 7:
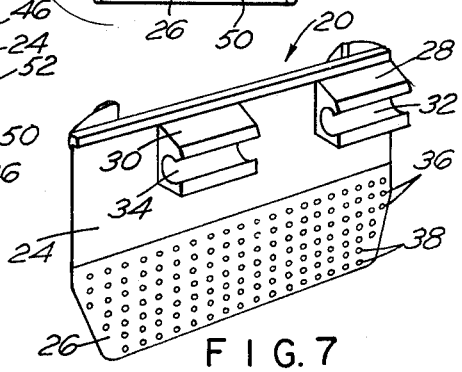
FIG. 7 is a perspective view of one of the clip jaw members as seen from the inside thereof.

In order to pivotally move the jaw members 20 from the closed to the open position or vice versa, the spring member 22 is provided and is received in sliding relation on the jaw members 20. In order to accommodate the spring member in sliding relation, the outer surface of each jaw member 20 is formed with a wide groove indicated at 40, the wide groove 40 extending through the upper portion 24 and terminating in the lower portion 26 of each jaw member. As further illustrated in FIGS. 4, 5 and 7, the uppermost edge of each jaw member 20, which also defines the upper edge of the groove 40, is formed with a longitudinally extending shoulder or ledge 42, the ledge 42 cooperating with the spring member 22, as will be described, to provide for moving of the jaw members 20 to the fully opened position thereof.

Figure 3:
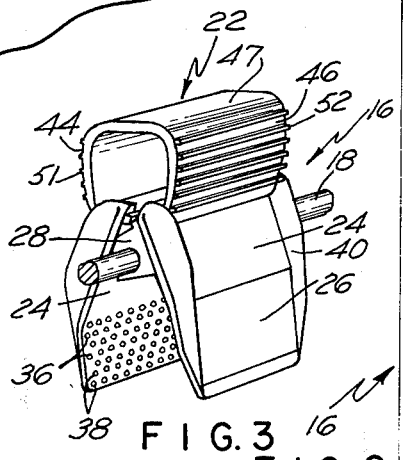
FIG. 3 is a perspective view of the clip as embodied in the present invention as mounted on a hang rod and located in the open position thereof.
Figure 6:
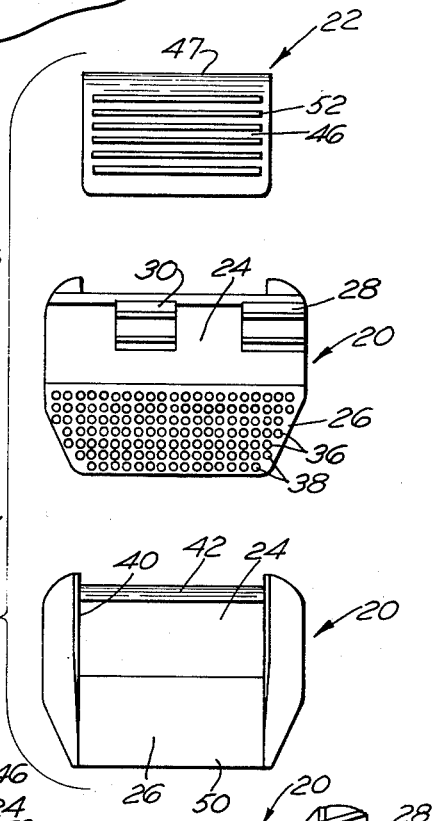
FIG. 6 is an exploded view showing the various parts of the clip in elevation.
Figure 4:
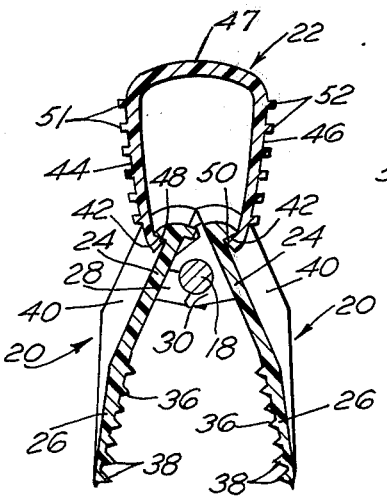
FIG. 4 is a sectional view of the clip embodied in the present invention as mounted on a hang rod and located in open position thereof.

As more clearly seen in FIGS. 3, 4 and 5, the spring member 22, which is also formed in a one-piece construction of plastic material, includes leg elements 44 and 46 that are integrally joined by a central bight portion 47. The leg element 44 is formed with a plurality of longitudinally extending projections 51 that define gripping surfaces for the spring member 22, and leg element 51 that define gripping is provided with similarly formed longitudinally extending grip projections 52. The leg elements 44 and 46 each have a generally curved configuration and tend to bow inwardly toward each other, the bottommost edge of the leg elements 44 and 46 being formed with longitudinally extending fingers 48 and 50, respectively. The width of the spring member 22 as defined by the leg elements 44 and 46 and the bight portion 47 is dimensioned to be slidably received within the groove 40 of the jaw members 20, the spring member 22 being movable relative to the jaw members 20 within the groove 40.

With the jaw members 20 mounted on the hang rod 18 for pivotal movement thereon as illustrated in FIGS. 3, 4 and 5, the spring member 22 is located in place on the jaw members by retracting the leg elements 44 and 46 until they snap over the ledges 42 and are received within the grooves 40 of each of the jaw members 20. Since the leg elements 44 and 46 of the spring member 22 tend to bow inwardly toward each other, movement of the spring member 22 in a downward direction to the position illustrated in FIG. 5 causes the jaw members 20 to be forced inwardly to the closed position thereof. By locating a garment or article between the jaw members 20 and particularly between the lower portions 26 of the jaw members on which the projections 36 and 38 are formed, the article will be securely clamped in place and suspended from the clip 16 when the spring member 22 is moved to the downward position thereof as illustated in FIG. 5. When it is desired to release the article from between the jaw members 20, the spring member 22 is pulled upwardly by grasping the leg elements 44 and 46 by the gripping projections 51, 52 thereof and pulling upwardly thereon. As the leg elements 44 and 46 slide upwardly with respect to the jaw members 20 within the groove 40 of each jaw member, the fingers 48 and 50 engage the longitudinally extending ledge 42 of each jaw member. Further upward movement of the spring member 22 causes the uppermost edges of each of the jaw members 20 to be pivotally moved inwardly toward each other as illustrated in FIG. 4 and the lowermost edges to be moved to the fully open position thereof, the pivotal movement of the jaw members 20 being accomplished by the engagement of the fingers 48 and 50 with the ledge 42 of each jaw member. It is understood that clamping of an article between the jaw members 20 is accomplished by simply placing the article between the jaw members and then pushing downwardly on the spring member 22 by exerting a downward force on the bight portion 47. As the leg elements 44 and 46 travel downwardly in the groove 40 of each jaw member 20, the leg elements force the jaw members 20 to the closed position thereof for capturing the article therebetween.

Figure 8:
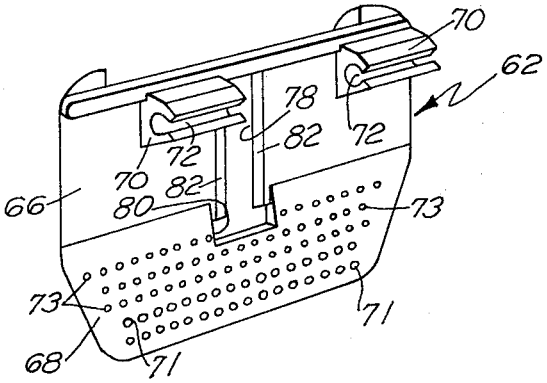
FIG. 8 is a rear perspective view of a modified form of clip jaw member.

Referring now to FIGS. 8 through 11, a modified form of the clip is illustrated and is generally indicated at 60. The clip 60 includes a pair of identical jaw members, each of which is generally indicated at 62, the jaw members 62 being retained in pivotal relation on a hanger by a spring member generally indicated at 64. Each jaw member 62 is molded of a plastic material and includes an upper portion 66 to which a lower inclined portion 68 is integrally joined. Molded as an integral part of each jaw member 62 on the rear surface of the upper portion 66 are spaced hinge clamps 70 which have arcuate grooves 72 formed therein for fitting over a hanger rod. Formed on the inside surface of the lower portion 68 of each jaw member 62 are projections 71 and 73 that cooperate with similar projections of the companion jaw member to retain a garment therebetween in suspended relation when the jaw members 62 are in the clamping position. In order to accomodate the spring member 64 in sliding relation on the jaw members, the outer surface of each jaw member 62 is formed with a wide groove 74 that extends through the upper portion 66 and terminates in the lower portion 68. The uppermost edge of each jaw member 62 that defines the upper edge of the groove 74 is formed with a rounded flange 76 that defines a shoulder 77 thereunder. Formed in the upper portion 66 of the jaw member 62 is a vertically extending slot 78 that communicates with a cross slot 80 formed in the lower portion 68, the slots 78 and 80 defining a "T" configuration. As seen in FIG. 8, the inside peripheral edges adjacent to the slot 78 are tapered and define bearing surfaces 82, the purpose of which will be described.

Formed in the wide groove 74 approximately at the junction of the upper and lower portions 66 and 68 is a longitudinally extending groove 84, which cooperates with the spring member 64 to retain the spring member in place when the clip is under load as will be described. As further seen in FIG. 9, ridges 86 are formed on the rear surface of the upper portion as contained in the groove, the purpose of which will also be described with reference to the spring member 64.

Figure 9:
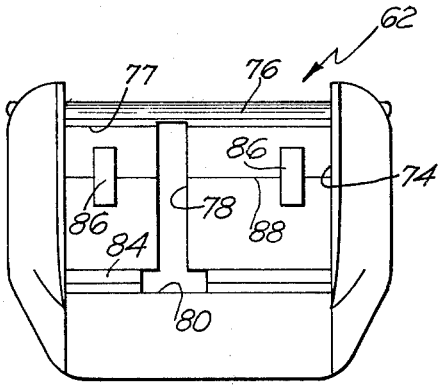
FIG. 9 is a front elevational view thereof.
Figure 11:
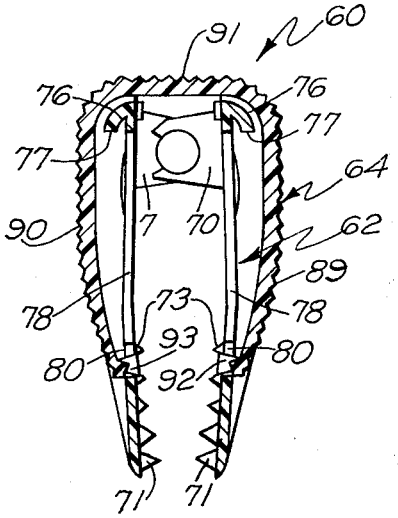
FIG. 11 is a sectional view showing the modified spring member mounted on the modified jaw members.
Figure 10:
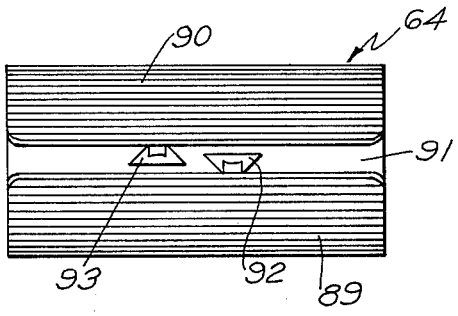
FIG. 10 is a bottom plan view of a modified spring member.

Referring to FIGS. 10 and 11, the spring member 64 is shown including leg elements 89 and 90 that are integrally joined by a central bight portion 91. The leg elements 89 and 90 are formed with external projections that provide for better gripping of the spring member. The width of the spring member 64 is dimensioned to be slidably received within the groove 74, the spring member 64 being movable relative to the jaw members 62. Formed on the inside surface of the leg elements 89, 90 adjacent to the free ends thereof are pins 92 and 93, respectively, which have a substantially "T" configuration. The pins 92 and 93 are shaped and dimensioned such that they are slidably received in the slots 100 of the jaw members 62 on which the spring member 64 is slidably mounted. The pins 92 and 93 move upwardly in their respective slots 100 in the jaw members 62 as the spring member 64 is retracted; and if for any reason the leg elements of the spring member had become outwardly set in the load position, the interconnection between the pins and slots will prevent dislodging of the spring member 64 as it is moved to the upper inactive position. Normally the inside tip on the lower end of the spring member leg elements engage the flanges 77 to restrict further upward movement of the spring member on the jaw members 62; but if the leg members have become outwardly set under load, the inside tips thereof would not engage their respective flanges and the spring member 64 would tend to detach from the jaw members 62. The interconnection of the pins 92 and 93 with their respective slots 100 ensures that the spring member 64 remains in engagement with the jaw members 62 at all times. It is also seen that the cross slots 80 provide for retraction of the "T" portion of the pins 92 and 93 when the spring member 64 is in the closed position in the jaw members. The bearing surfaces 82 receive the wings of the "T" shaped pins 92 and 93 thereon and provide for smooth movement thereof as the spring member 64 moves relative to the jaw members. As seen in FIG. 9, ridges 86 are provided so as to prevent the inside tips of the leg elements 89 and 90 from engaging a parting line 88 as the spring member 62 slides on the jaw members 62, whereby the spring member 64 cannot stick in position as it moves relative to the jaw members 62.

Figure 12:
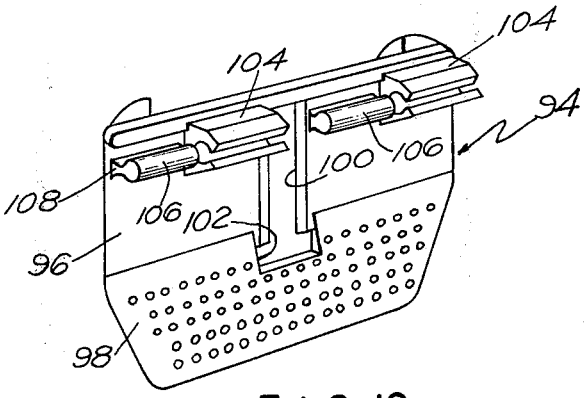
FIG. 12 is a rear perspective view of a still further modified form of jaw member.

Referring now to FIG. 12, a further modified form of the invention is illustrated although only a single jaw member generally indicated at 94 is shown. The form of the invention illustrated in FIG. 12 avoids the use of a hanger on which the jaw members shown in the previously described clips were mounted. The clip in which jaw member 94 is incorporated is mountable on an article independent of a hanger and as such is usable in much the same manner as a clothespin. The jaw member 94 includes an upper portion 96 to which a lower inclined portion 98 is joined. Formed in the upper portion is a slot 100 that terminates at its lower end in a cross slot 102, the slots 100 and 102 accommodating "T" pins of a spring member as illustrated in FIGS. 10 and 11. Spaced hinge clamps 104 are joined to the rear surface of the upper portion 96, and located adjacent to the hinge clamps 104 are hinge pins 106 that are joined to the upper portion 96 by reduced portions 108.

A pair of jaw members 94 are pivotally interconnected by mounting the hinge clamps 104 of each jaw member on the hinge pins of the other jaw member. The spring member 64 as illustrated in FIG. 10 is then mounted on the jaw members 94 to complete the assembly. The operation of the spring member 64 on the jaw members 94 is essentially the same as described above, and it is understood that the clip as just described may be utilized independently of a horizontal rod and therfore has an infinite variety of uses.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clip for suspending an article thereform, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw members for positively moving said jaw members in a pivotal movement to a fully open position when said spring member is pulled outwardly relative to said jaw members, wherein the article clamped between said jaw member is released therefrom, each of said jaw members including a pair of longitudinally spaced and aligned hinge clamps through which a hang rod extends for pivotally mounting said jaw members thereon, said hang rod defining the hinge axis of said jaw members.

2. A clip as claimed in claim 1, said spring member being formed in a unitary construction and including a bight portion that is joined to said leg elements, said leg elements being shaped such that the space therebetween decreases from the bight portion to the outermost ends of said leg elements wherein said leg elements force said jaw members together in the closed position thereof when the spring member is fully inserted into overlying relation on said jaw members.

3. A clip as claimed in claim 1, said means formed on said jaw members including a longitudinally extending ledge located adjacent to the hinge axes thereof, and said means formed on said spring member including an inwardly directed longitudinally extending finger formed on each leg element of the spring member adjacent to the outermost end thereof and being engageable with a ledge when said spring member is pulled outwardly for pivotally moving said jaw members to the fully open position thereof.

4. A clip as claimed in claim 3, each of said jaw members and spring members being molded of a plastic material in a unitary construction.

5. A clip as claimed in claim 3, a groove formed in the exterior surface of each jaw member and being dimensioned for receiving a leg element of said spring member in sliding relation therein.

6. A clip as claimed in claim 5, said leg elements of said spring member having a generally curved configuration with the outer ends of said leg elements being spaced apart a lesser dimension than that of the width of said bight portion, wherein said leg elements are placed under tension when the spring member is mounted on said jaw members, so that the tension in said leg elements forces said jaw members to a closed position when the leg elements overlie substantially the full extent of the groove as formed in the jaw members.

7. A clip as claimed in claim 1, each jaw member having an upper portion and a lower portion, said lower portion being inclined inwardly with respect to the upper portion and cooperating with the lower portion of the opposed jaw member to clamp the article therebetween when the jaw members are located in the closed position thereof.

8. A clip as claimed in claim 7, a first group of projections formed on the inside surface of each of said jaw members, and a second group of projections formed on the insdie surface of each of said jaw members, the projections of said second group having a length greater than that of the projections of said first group.

9. A clip as claimed in claim 1, said means formed on said spring member further including pins and said means formed on said jaw members further including slots for receiving said pins, said pins and slots further cooperating to prevent accidental disengagement of said spring member from said jaw members, when the spring member is moved to the fully open position.

10. A clip as claimed in claim 1, a longitudinally extending groove formed in each of said jaw members for receiving the end of a leg element of said spring member when the spring is in the closed position, whereby said spring member remains in engagement with said jaw members when said jaw members are spread with an article located therebetween.

11. A clip for suspending an article therefrom, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw members for positively moving said jaw members in a pivotal movement to a fully open position when said spring member is pulled outwardly relative to said jaw members, wherein the article clamped between said jaw members in released therefrom, said means formed on said jaw members including a longitudinally extending ledge located adjacent to the hinge axes thereof, and said means formed on said spring member including an inwardly directed longitudinally extending finger formed on each leg element of the spring member adjacent to the outermost end thereof and being engageable with a ledge when said spring member is pulled outwardly for pivotally moving said jaw members to the fully open position thereof, each of said jaw members having a pair of hinge clamps formed on the inside surface thereof, a groove formed in each hinge clamp that is shaped for receiving a hang rod in sliding relation therein, wherein said jaw members are pivotally and slidably mounted on said hang rod, the grooves as formed in said hinge clamps defining the hinge axis of said jaw members.

12. a clip as claimed in claim 11, the spacing between A hinge clamps on each jaw member being such as to accommodate a hinge clamp of the other jaw member, wherein the hinge clamps of said jaw members are arranged in alternate relation on said hang rod.

13. A clip for suspending an article therefrom, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw member for positively moving said jaw members in a pivotal movement to a fully open position when said spring member is pulled outwardly relative to said jaw members, wherein the article clamped between said jaw members is released therefrom, said means formed on said spring member further including pins and said means formed on said jaw members further including slots for receiving said pins, said pins and slots further cooperating to prevent accidental disengagement of said spring member from said jaw members, when the spring member is moved to the fully open positions, each of said pins having a "T" configuration that includes a head portion that is captured within each slot in a jaw member, wherein the pins are movable in confined relation within said slots.

14. A clip for suspending an article therefrom, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw members for positively moving said jaw members in a pivotal movement to a fully open position when said spring member is pulled outwardly relative to said jaw members, wherein the article clamped between said jaw members is released therefrom, each of said jaw members including spaced hinge clamps that are joined to the inside surface thereof, and a pair of hinge pins joined directly to the inside surface of said jaw members, each of said hinge pins being receivable in a hinge clamp of the opposite jaw member for pivotally interconnecting said jaw members.

15. A clip for suspending an article therefrom, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw members for positively moving said jaw members in a pivotal movement to a fully open position when said spring member is pulled outwardly relative to said jaw members, wherein the article clamped between said jaw members is released therefrom, each of said jaw members including longitudinally spaced and aligned hinge clamps that are joined to the inside surface thereof, each of the hinge clamps as joined to one jaw member being staggered in position relative to the spaced hinge clamps as joined to the other jaw member so as to be located therebetween when said jaw members are mounted in the position of use, and means located on said common hinge axis and engaging said hinge clamps for mounting said jaw members in pivotal relation with respect to each other.

16. A clip for suspending an article therefrom, comprising a pair of jaw members that are hingedly mounted about a common hinge axis and that are pivotally movable to a closed position for clamping an article therebetween, and a spring member mounted on said jaw members for relative movement with respect thereto and having leg elements that are urged inwardly toward each other and that overlie said jaw members in the closed position for urging said jaw members into the closed position for clamping said article therebetween, means formed on said spring member cooperating with means formed on said jaw members for positively moving said jaw members in a pivotal movement to a fully open position when said spring member is pulled outwardly relative to said jaw members, wherein the article clamped between said jaw members is released therefrom, each of said jaw members having a pair of hinge clamps formed on the inside surface thereof, a groove formed in each hinge clamp that is shaped for receiving a hang rod in sliding relation therein, wherein said jaw members are pivotally and slidably mounted on said hang rod, the grooves as formed in said hinge clamps defining the hinge axis of said jaw members.

* * * * *